US005915556A

United States Patent [19]

Simpson

[11] Patent Number: 5,915,556

[45] Date of Patent: Jun. 29, 1999

[54] SHOCK ABSORBING COMPONENT FOR PACKAGING

[76] Inventor: Eugene D. Simpson, 490 Cambridge Ave., Palo Alto, Calif. 94306

[21] Appl. No.: 08/943,516

[22] Filed: Oct. 3, 1997

[51] Int. Cl.[6] ..... B65D 73/00

[52] U.S. Cl. ..... 206/461; 206/471; 206/521; 206/784

[58] Field of Search ..... 206/461, 462, 206/463, 464, 465, 466, 467, 469, 470, 471, 521, 525.1, 583, 591, 594, 495, 784; 229/87.03; 383/118

[56] References Cited

U.S. PATENT DOCUMENTS

| | | | |
|---|---|---|---|
| 43,974 | 8/1864 | Converse . | |
| 758,138 | 4/1904 | Hinde . | |
| 1,123,884 | 1/1915 | Jones et al. . | |
| 2,448,401 | 8/1948 | Stone . | |
| 2,646,165 | 7/1953 | Whitehead . | |
| 2,738,056 | 3/1956 | Heller | 206/583 |
| 2,771,184 | 11/1956 | Ryno et al. . | |
| 3,655,501 | 4/1972 | Tesch | 383/118 |
| 3,752,301 | 8/1973 | Bluemel . | |
| 3,780,933 | 12/1973 | Freeman . | |
| 3,819,033 | 6/1974 | Hueber | 229/87.03 |
| 3,958,751 | 5/1976 | Bruno | 383/118 |
| 4,191,289 | 3/1980 | Austin . | |
| 4,572,362 | 2/1986 | Kronfeld | 206/521 |
| 4,759,444 | 7/1988 | Barmore | 206/583 |
| 5,325,967 | 7/1994 | Gonzales . | |
| 5,417,341 | 5/1995 | Petriekis et al. | 206/495 |
| 5,425,499 | 6/1995 | Pfieffer | 206/383 |
| 5,738,218 | 4/1998 | Gonzales | 206/583 |

FOREIGN PATENT DOCUMENTS

| | | | |
|---|---|---|---|
| 4200353 | 7/1993 | Germany | 206/461 |

*Primary Examiner*—Paul T. Sewell
*Assistant Examiner*—J. Mohandesi
*Attorney, Agent, or Firm*—Morrison & Foerster LLP

[57] ABSTRACT

The present invention relates to a shock absorbing component for packaging an article and for protecting the article during shipping. The component is foldable (preferably from a single sheet) for enclosing the article therein. The component comprises a first section for receiving a first surface of the article and a second section for receiving a second surface of the article. The first section having multiple nonlinear cuts or serrations such that upon placing the article between the first and second sections, the cuts allow the first section to deform and at least partially conform to the shape of the first surface of the article. The component may be disposed within and integrally formed with a shipping container having exterior protective walls. The component may further comprise spacer panels to separate the component from the exterior walls of the shipping container. Although the disclosed shipping container may have open ends, it desirably has ends completing the enclosure.

23 Claims, 10 Drawing Sheets

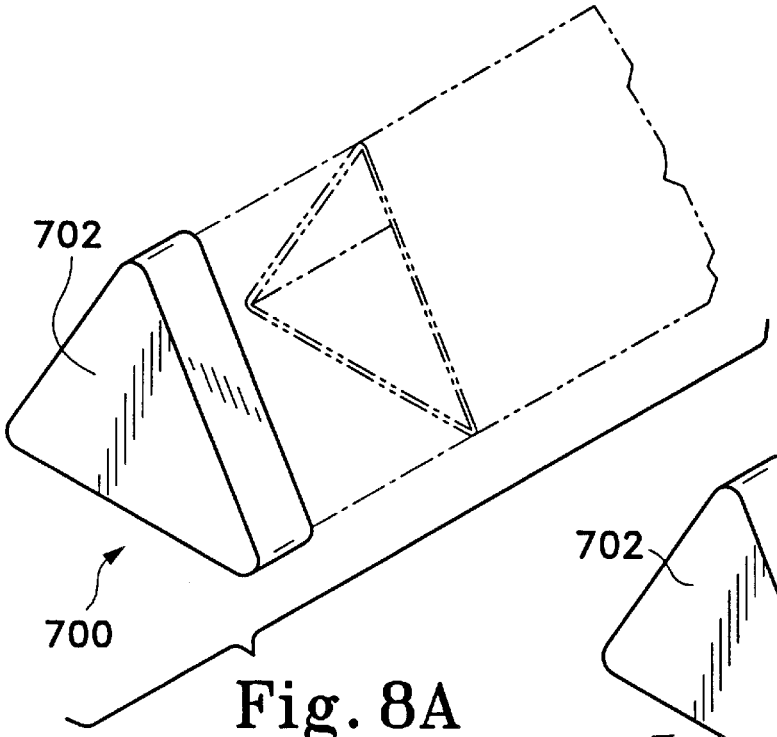
Fig. 8A
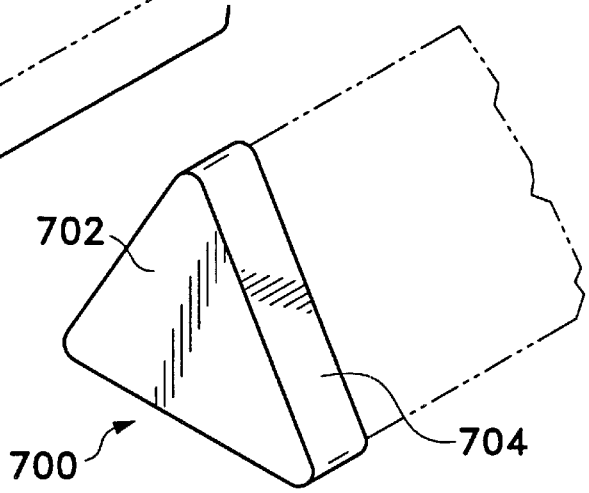
Fig. 8B
Fig. 9A
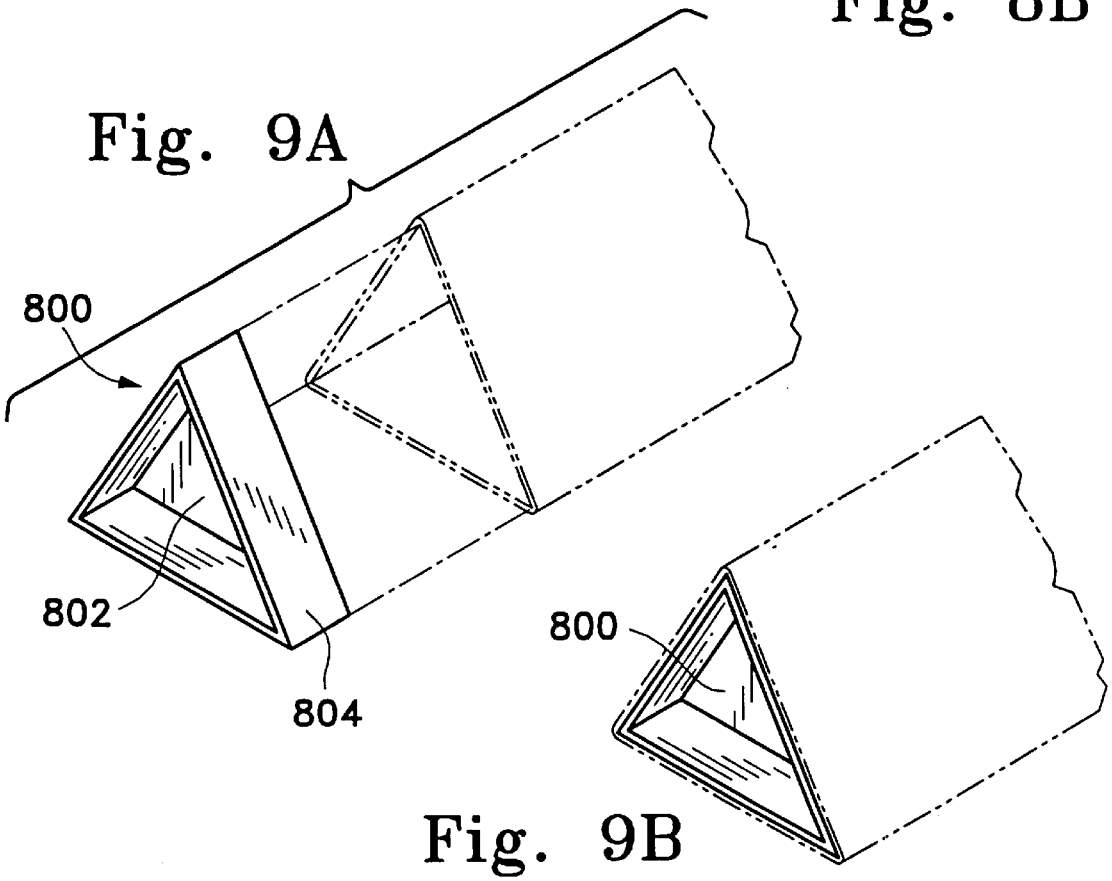
Fig. 9B

SHOCK ABSORBING COMPONENT FOR PACKAGING

FIELD OF THE INVENTION

The present invention relates to a shock absorbing component for packaging an article and for protecting the article during shipping. Specifically, the present invention relates to a packaging component, preferably foldable, having cuts or serrations at a location where the article is to be disposed within the component. The cuts or serrations allow the component to deform and at least partially conform to the shape of the portion of the article in contact with the cuts or serrations.

BACKGROUND OF THE INVENTION

Packaging of small articles for shipping often relies on the use of a simple rectangular box filled with various types of filler materials such as well known Styrofoam "peanuts," popcorn, foam rubber, expanded starch packing material, etc. Each of these packing materials, however, is unhandy in that they create debris which preferably is recycled but often is not. Storage of the packing material prior to use consumes storage space. Most shipping costs are based on weight and, although the weight of most of the noted packing materials is quite small, there seems little reason to pay for it.

There are a number of patents showing containers which maintain and protect the articles to be packaged away from the walls of the container during shipping. For instance, U.S. Pat. No. 2,771,184 to Ryno et al. shows a cylindrical package in which the object to be protected is suspended between the two ends of a cylinder by a twisted plastic tube. The plastic tube is twisted tied above and below the article and held in tension in the center of the tube during shipping.

U.S. Pat. No. 3,752,301, to Bluemel, shows a shock-proof packing container having a rectagonal outer carton and a polygonal inner support member. The polygonal support member is configured in such a way that it fits snugly inside the outer carton and in turn supports a flexible sling. The articles to be shipped are wrapped in the sling and are suspended in the interior both of polygonal inner member and the rectangular outer box.

U.S. Pat. No. 5,325,967, to Gonzales, shows a packaging device also formed of an outside container and having a removable inner platform which, via the use of folded and integrated spacers, causes the object to be protected to be spaced apart from the walls of the container. The object to be shipped is held against the inner platform by, for instance, a plastic bag which envelops the object and that bag passes through an orifice within the support platform and is attached in some fashion to the edge of that platform. Other variations of protective packaging found in the prior art are also discussed in U.S. Pat. No. 5,325,967.

It is therefore desirable to provide a packaging component for protecting an article to be packaged and for spacing the article away from the walls of an exterior container. It is also desirable to provide a packaging component which eliminates or minimizes the need for filler materials, is recyclable, light weight, and requires only a relatively small volume for storage

SUMMARY OF THE INVENTION

The present invention relates to a shock absorbing component for packaging an article and for protecting the article during shipping. The component eliminates the need and the desire for filler protective material. The component comprises a piece of packaging material, preferably foldable, in which the article to be packaged is disposed. Preferably, the material is paper cardboard, e.g., corrugate, although any suitable flat material such as paper bonded Styrofoam board or polyolefin flat stock materials simulating paper corrugate or the like may be suitable. The foldable material has a first section, a second section and a foldable seam therebetween. At least the first section contains cuts or serrations through the thickness of the first section. Some or all of the cuts or serrations are located where the article is to be placed relative to the first section. The cuts or serrations allow the component to deform and at least partially conform to the shape of the portion of the article in contact with the cuts or serrations.

The article is placed on the second section and the first section is folded along the foldable seam onto the article and the first section. The cuts or serrations enable the first section to deform and generally conform to the shape of the portion of the article contacting the first section. A portion of the first section extending beyond the periphery of the article contacts a portion of the second section extending beyond the periphery of the article to enclose the article within the folded component. The two sections are then preferably secured together.

For shipping, the component enclosing the article therein can be placed within a shipping container, such as one described in U.S. Pat. No. 5,738,218, entitled "Foldable Protective Packaging"(Ser. No. 08/741,092), the entirety of which is hereby incorporated by reference. The shipping container comprises three or more protective outer walls which form the outer surface of the overall package. The shipping container is preferably formed of an integral piece of material and may further be integrally formed with the shock-absorbing component. The shipping container preferably has a triangular cross-sectional shape although a square or rectangular cross-sectional shape may also be suitable. Ends of the shipping container is preferably integral with the shipping container material simply folded into place as needed. Alternatively, the ends may be independent elements which are plugged into or capped onto the open ends of the shipping container.

To prevent or minimize contact between the shipping container and the shock-absorbing component enclosing the article, the shock-absorbing component may further comprise spacer flaps, each flap sharing an edge with the foldable component. The spacer flaps separate the component enclosing the article from the exterior walls of the shipping container by some discrete distance. Thus, the component also serves as a support platform within the outer walls of the shipping container.

BRIEF DESCRIPTION OF THE DRAWINGS

FIGS. 8A and 8B show front quarter views of caps suitable for placement on the ends of a component-shipping container assembly such as shown in FIGS. 3C, 4C or 5C.

FIGS. 9A and 9B show front quarter views of caps suitable for placement within the ends of a component-shipping container assembly such as shown in FIGS. 3C, 4C or 5C.

DESCRIPTION OF THE INVENTION

Figure 1A:
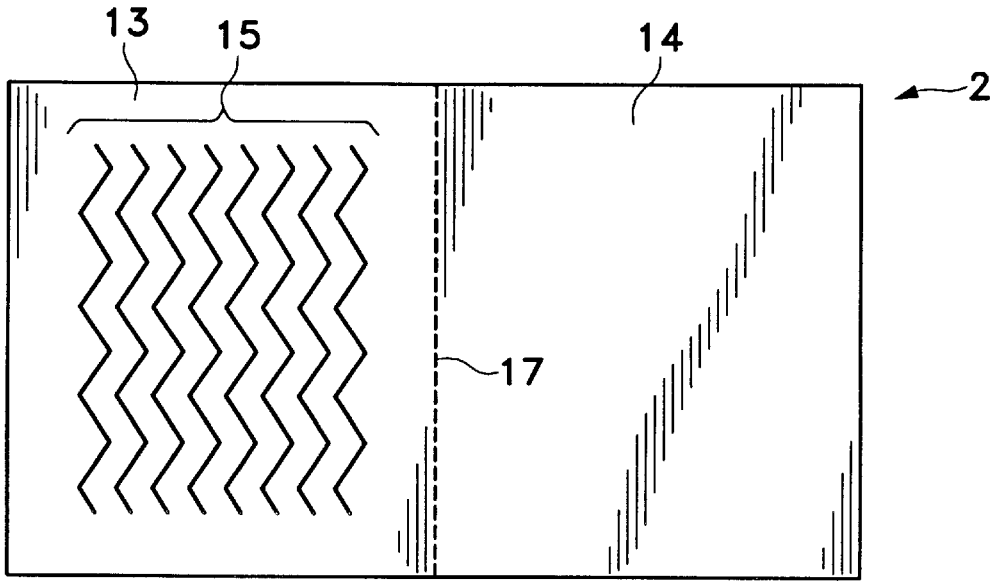
FIG. 1A is a plan view of an unfolded shock-absorbing component in one embodiment of the present invention.
Figure 1B:
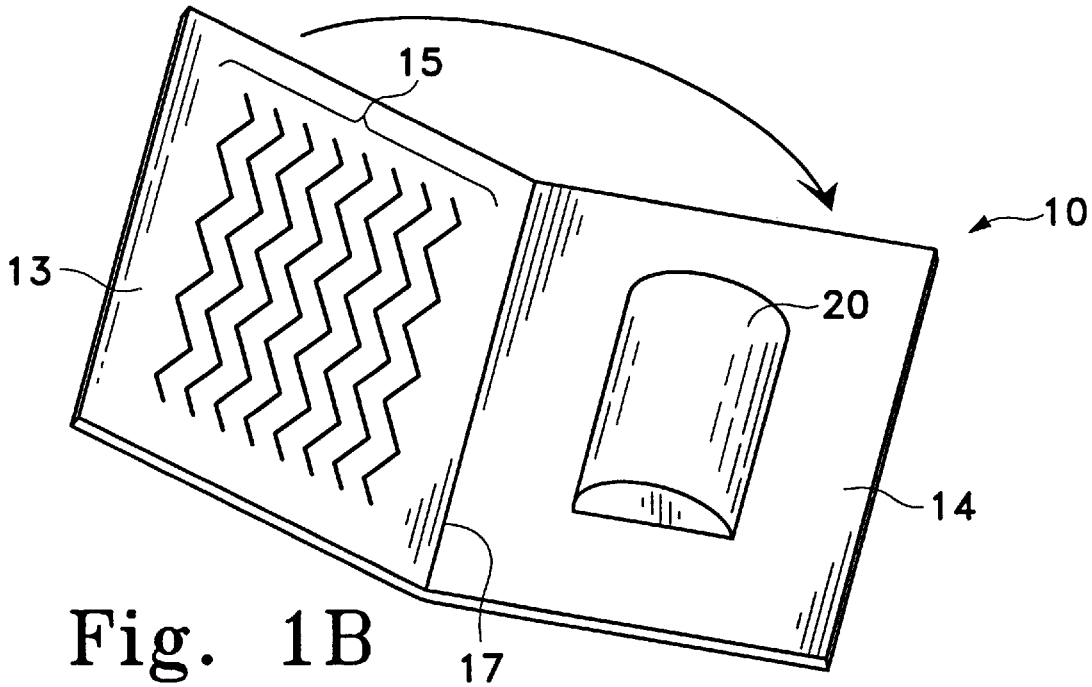
FIG. 1B is a perspective view of a partially folded component of FIG. 1A with an article to be packaged.
Figure 1C:
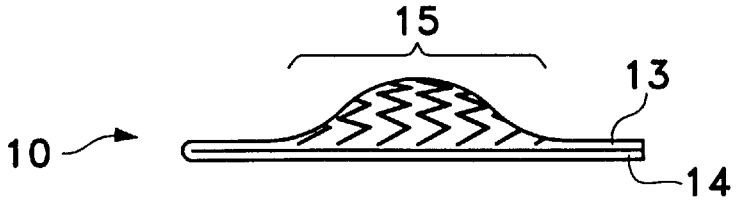
FIG. 1C is an end view of a fully folded component and article of FIG. 1B.

One embodiment of the shock absorbing component for packaging is generally shown in FIGS. 1A–C. FIG. 1A shows a flat sheet (2) which, as shown in FIG. 1B, is foldable into the folded shock-absorbing component (10) shown in FIG. 1C. Flat sheet (2) has a first section (13), a second section (14), and a foldable seam (17) between the two sections (13) and (14). Although the first and second sections (13) and (14) are preferably made from a single flat sheet, the first and second sections (13) and (14) may alternatively be made of a plurality of separate sheets, as can be easily understood and adapted by one of ordinary skill in the art.

The first section (13) has a plurality of cuts or serrations (15) extending through the thickness of the first section (13). An article to be packaged (20) may be placed on the second section (14) and the first section (13) is then folded along the seam (17) onto the article (20), thereby forming the folded component (10), as shown in FIG. 1C. The cuts (15) allow the first section (13) to deform and generally conform to the shape of the portion of the article contacting the first section (13). To further enclose and protect the article (20) within the folded component (10), a portion of the first section (13) extending beyond the periphery of the article (20) contacts a portion of the second section (14) extending beyond the periphery of the article (20). Thus, the article (20) is preferably fully enclosed within the folded component (10). The two sections (13) and (14) are preferably secured together by an adhesive, clip, staple, or other types of fasteners.

As noted above, the material of the single or multiple sheets (2) may be any appropriate, and preferably recyclable, sheet stock. Most corrugate is made from kraft paper or other similar paper stock. Of course, depending on the service into which the packaging is placed, other materials may be selected, e.g., polyethylene terephthalate (Mylar), polyethylene sheet, polypropylene (clear or fibrous paper product), or the like are acceptable. The sheet stock may be corrugate or may, of course, have a honeycomb core. The way in which the edges are creased and then sealed are obviously dependent upon the material from which the packaging is made. For instance, a corrugate or honeycomb flat stock may be simply creased or partially scored. Thermoplastic polymeric materials such as fibrous polypropylene or Mylar may be provided with seams by the use of heat.

Figure 2A:
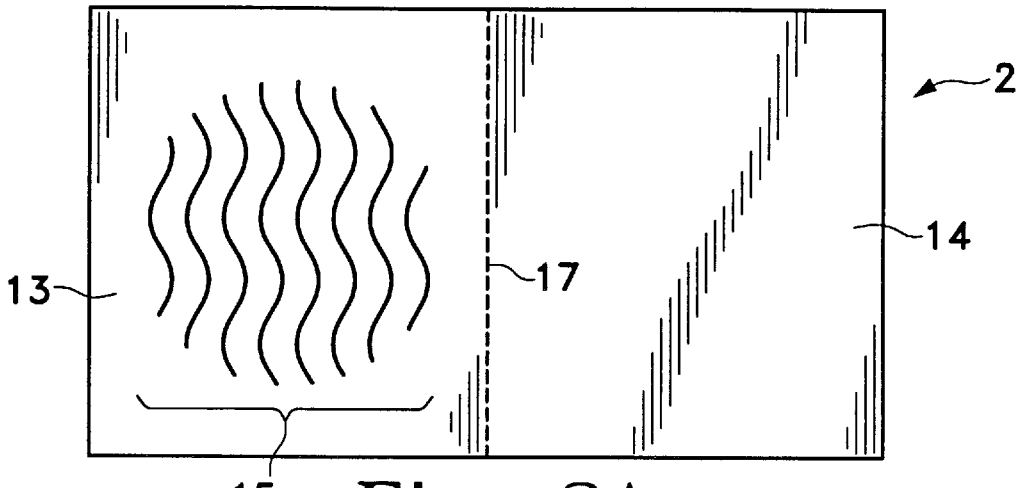
FIG. 2A–2E are plan views of unfolded shock-absorbing component of various alternative embodiments of the present invention.
Figure 2B:
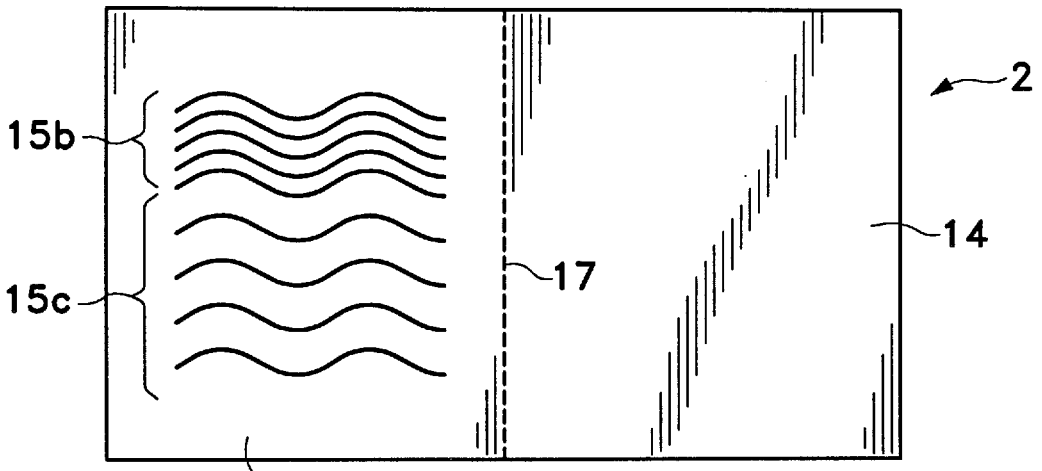

As shown in FIGS. 1A–1C, the cuts (15) may be a plurality of zig zag cuts. Alternatively, as shown in FIG. 2A, the cuts (15*a*) may be of different nonlinear shapes, such as tortuous or sinuous and/or the cuts (15) may be of varying lengths, for example, depending upon and in order to accommodate the particular shape of the article to be packaged. The cuts (15) may be spaced generally evenly apart. However, where the portion of the article contacting the first section (13) is not of a uniform size, the cuts (15) may be spaced closer together (15*b*) to accommodate part(s) of the article (20) that are larger and spaced farther apart (15*c*) to accommodate part(s) of the article that are smaller, as shown in FIG. 2B.

Figure 2C:
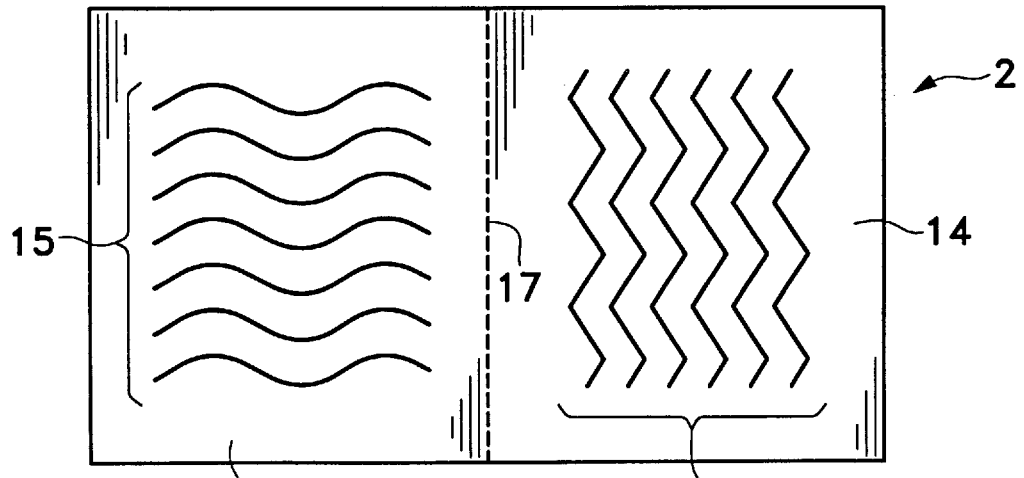
Figure 2D:
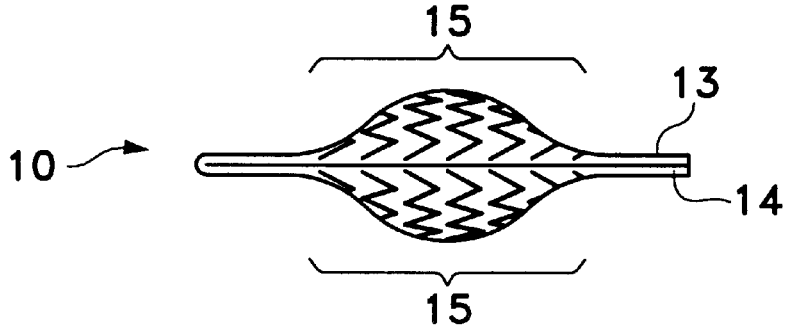

Furthermore, where the portion of the article (20) contacting the second section (14) does not lay flat against the second section (14), the second section (14) may also contain cuts (15*d*), as shown in FIGS. 2C and 2D. Cuts disposed on the second section (14) may be the same as or mirror the cuts (15) disposed on the first section (13). Alternatively, the cuts (15*d*) disposed on the second section (14) may be of a different orientation and/or configuration as the cuts (15) disposed on the first section (13).

Figure 2E:
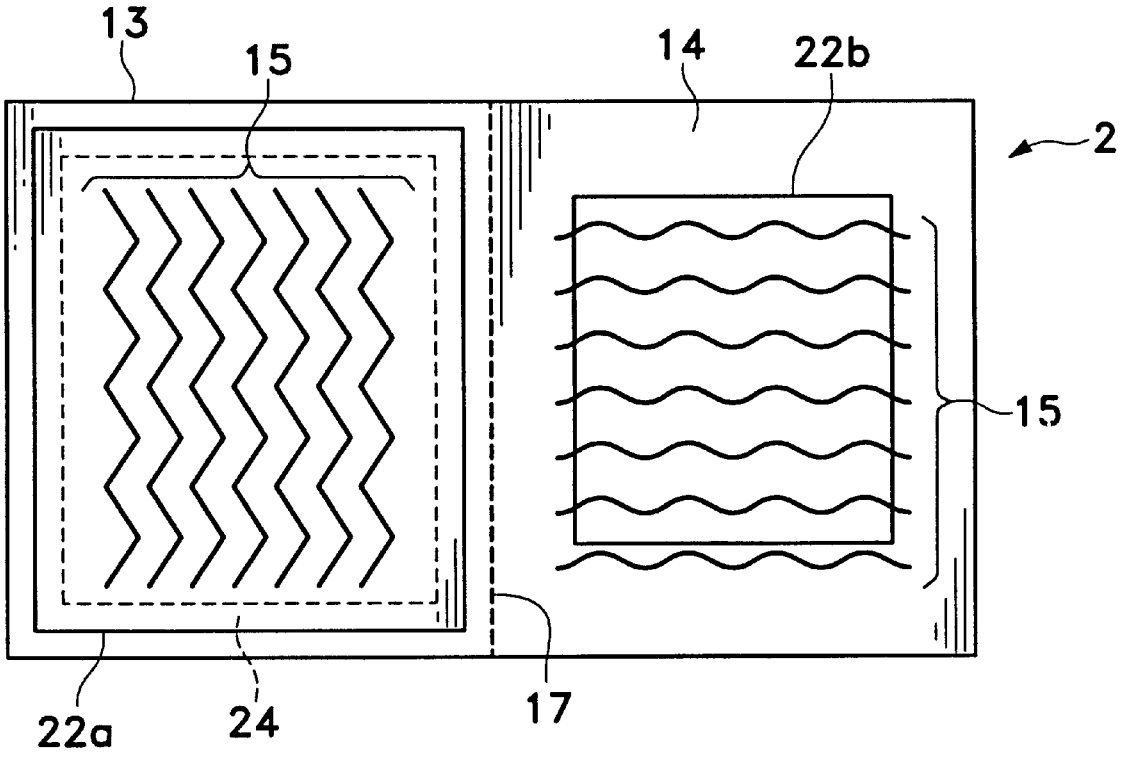

As shown in FIG. 2E, one or more plastic sheets (22) may be affixed to the flat sheet (2) to cover at least a portion of the cuts (15). By way of example, the plastic sheet (22*a*) may completely cover the cuts (15) disposed on the first section (13) and be affixed thereto by applying an adhesive (24) along the border of the first section (13) and/or the border of the plastic sheet (22*a*). The plastic sheet (22*a*) is expandable and deformable to conform to the shape of the article (20). The plastic sheet (22*a*) is preferably uncut so that when the article (20) is disposed between the first and the second sections (13) and (14), the article (20) is further enclosed and protected by the plastic sheet (22*a*).

Alternatively, the plastic sheet (22*b*) may only partially cover the cuts (15) on, for example, the second section (14) and is affixed to the second section (14) by an adhesive (not shown), preferably applied to the entire area of the plastic sheet (22*b*). Preferably, the cuts (15) extend through the plastic sheet (15*b*) so that both the plastic sheet (22*b*) and the second section (14) can deform to conform to the shape of the article (20).

Where both the first and second sections (13) and (14) contain cuts (15) therethrough, one or more plastic sheets (22) may be affixed to one or both of the sections. In addition, a single plastic sheet (22) may be affixed to both sections with adhesive applied along the area of the seam (17) and the border of the flat sheet (2) and/or the border of the plastic sheet (22).

As can be appreciated by one of ordinary skill in the art, the choice of the configuration, orientation and/or spacing of the cuts (15) as well as the choice of having cuts (15) on the first section (13), the second section (14), or both sections may be a variety of factors so as to optimize the protection afforded by the component (10) of the present invention. Such factors include the shape, size, shock resistancy and/or other characteristics of the article (20) to be packaged and/or the material(s) used for the first section (13) and the second section (14).

Shock-Absorbing Component and Shipping Container Assembly

For shipping, the shock-absorbing component (10) enclosing the article (20) therein can be placed within a shipping container. Preferably, the flat sheet (2) for forming the folded component (10) is integrally formed with a sheet for forming the shipping container.

FIGS. 3–7 show various examples of a single flat sheet (102, 202, 302, 502, 602) foldable into a shipping container and the shock-absorbing component for enclosing the article (20). Although the plastic sheet (22) described above is not described with the following examples, it is to be understood by one of ordinary skill in the art that any of the component-shipping container assembly examples below may incorporate one or more plastic sheets (22) in accordance with the descriptions above.

The shipping container comprises a plurality of protective walls which form the outer surface of the overall package and which form a protective volume for containing the component (10). One or more spacer panels (or spacer flaps) are attached to the component (10) to space the component (10) away from the exterior walls. The shipping container and the component may be used with various independent end closures for closing the ends of the overall shipping container. Each of the examples will now be described in detail below with reference to the specific Figures.

Figure 3A:
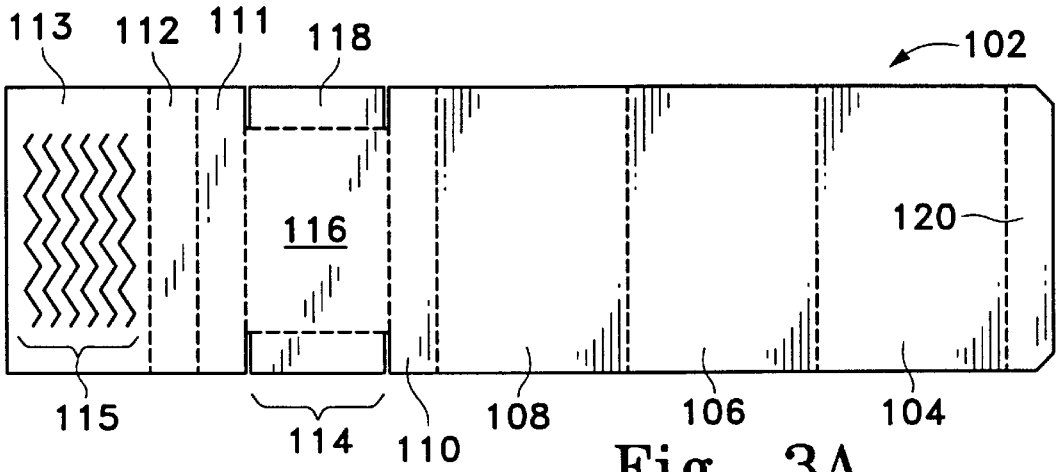
FIG. 3A is a plan view of an alternative embodiment of an unfolded shock-absorbing component of the present invention integral with and foldable into a triangular component-shipping container assembly.
Figure 3B:
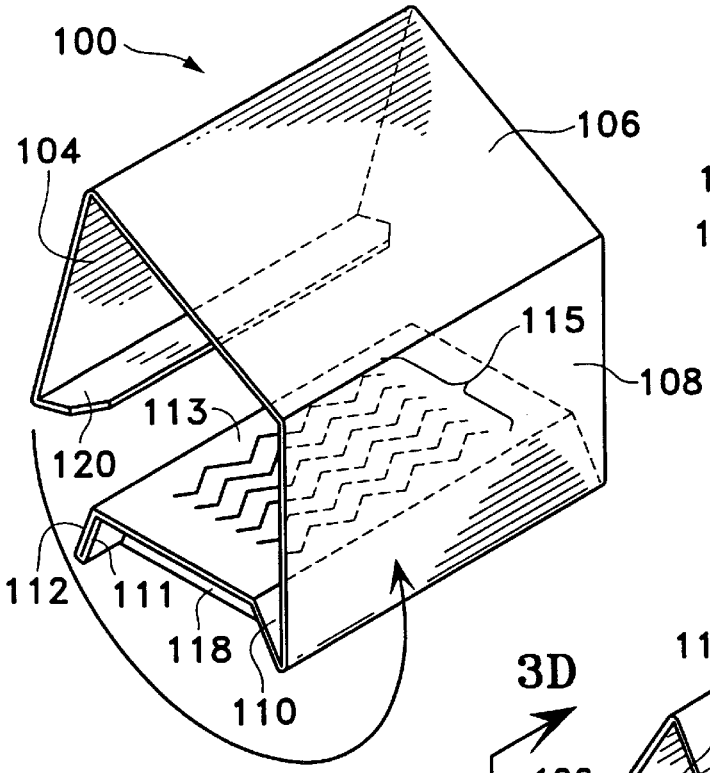
FIG. 3B shows the way in which the unfolded flat sheet of FIG. 3A is folded into the component-shipping container assembly.
Figure 3D:
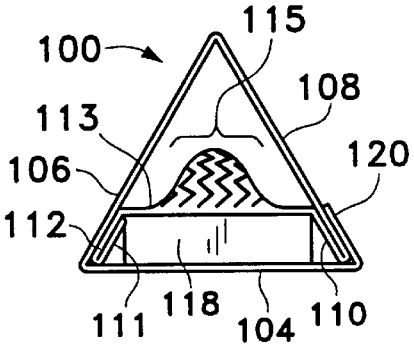
FIG. 3D is an end view of the folded component-shipping container assembly of FIG. 3C.
Figure 3C:
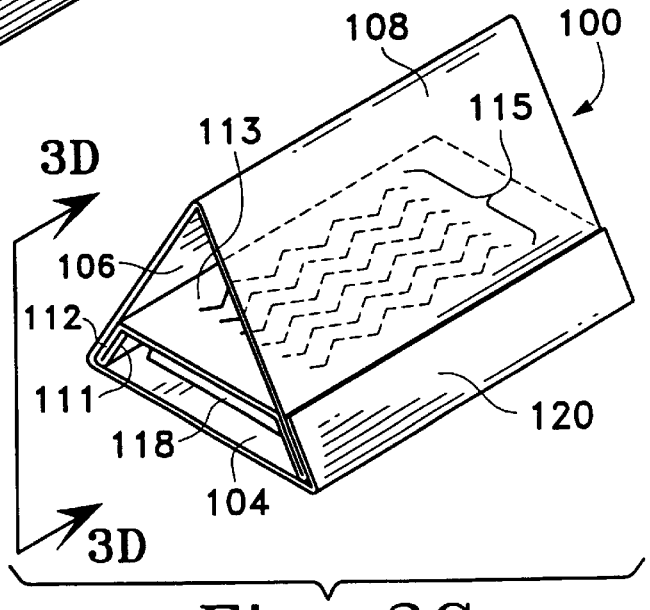
FIG. 3C is a perspective view of the folded component-shipping container assembly resulting from the folding of the flat sheet of FIG. 3*a*.

Referring now to FIGS. 3A–3D, a flat sheet (102) is foldable into the component-shipping container assembly (100) shown in FIGS. 3C and 3D. The flat sheet (102) has three exterior container walls (104), (106) and (108) with a foldable seam between each adjoining set of container walls (104), (106), (108). The component-shipping container assembly (100) includes spacer panels (110), (111), and (112), a first section (113) with multiple cuts (115) and a second section (114) of the component. The second section (114) provides a pair of support tabs (118) and a region or field (116) between the support tabs (118) upon which to place the article (20).

The sheet (102) may also include an optional assembly panel (120) which is used as a surface to provide the folded assembly (100) with rigidity. Assembly panel (120) may be spread with a water-based glue, an adhesive, or some type of mechanical attachment component such as VELCRO, or may be simply used as a surface for staples or the like. The method of adhesion of the assembly panel (120) to the rest of the assembly is not particularly critical to this invention.

FIG. 3B shows the way in which the inventive assembly is folded. The seams adjoining the two support tabs (118) are folded in such a way that the resulting region (116) is pushed towards the center of the resulting assembly (100). After placing an article to be shipping (not shown) on the region (116), the first section (113) is folded along the seam between spacer panels (111) and (112) toward the region (116) of the second section (114) such that the first section (113) and the region (116) generally overlap to enclose the article therebetween. Spacer panels (110), (111) and (112) are then folded similar to the support tabs (118) such that region (116) is pushed towards the center of the resulting assembly (100).

Exterior container walls (108), (106), and (104) are then folded around region (116) in such a way that spacer panels (111) and (112) are adjacent exterior panel (106) and spacer panel (110) is adjacent exterior panel (108). Assembly panel (120) is wrapped all the way around until it can be placed flat against exterior panel (108). In the resulting assembly (100), spacer panel (110) extends to a fold line of container wall (108) and similarly, each of spacer panels (111) and (112) extends to a fold line of container walls (104) and (106). As may be better seen in FIG. 3C, support tabs (118) are folded towards exterior panel (104) so to provide a measure of rigidity to resulting support region (116). Again, assembly panel (120) may be glued or stapled or otherwise made adherent to exterior panel (108).

FIG. 3D shows an end view of the folded component-shipping container assembly (100) of the present invention. The first section (113) is shown to be deformed by the article enclosed within the first and second sections (113) and (114).

It should be apparent that when assembly flap (120) is sealed against exterior container wall (108), the overall assembly (100) is a determinate structure. The spacer flaps (110), (111) and (112) support the first and second sections (113) and (114) as well as the article (20) enclosed therein away from the exterior walls (104), (106) and (108) of the shipping container.

FIGS. 4–7 similarly show a single flat sheet foldable into a component-shipping container assembly. However, for purposes of simplicity and clarity, the cuts (15) are not shown in FIGS. 4–7. As can be appreciated and understood by one of ordinary skill in the art, the first section and/or second section of any of the embodiments of the component-shipping container assembly described herein may utilize the different cuts (15) described in connection with FIGS. 2A–2C. In addition, similar to the assembly (100) of FIGS. 3A–3D, the spacer panel(s) in each of the resulting assemblies, extends to a fold line of a container wall.

FIGS. 4A–4C and 5A–5C show slightly simplified versions of the triangular component-shipping container assembly (100).

Figure 4A:
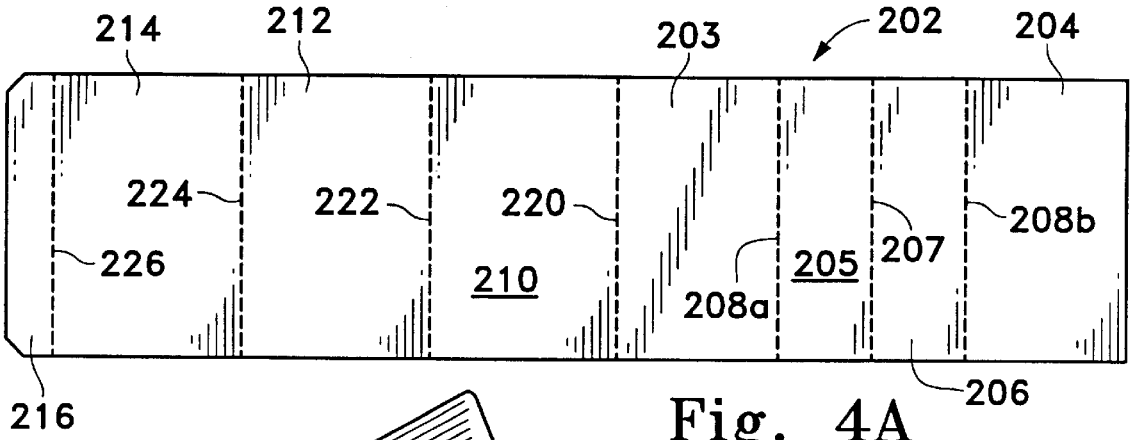
FIG. 4A is a plan view of an alternative embodiment of an unfolded shock-absorbing component of the present invention integral with and foldable into a triangular component-shipping container assembly.
Figure 4B:
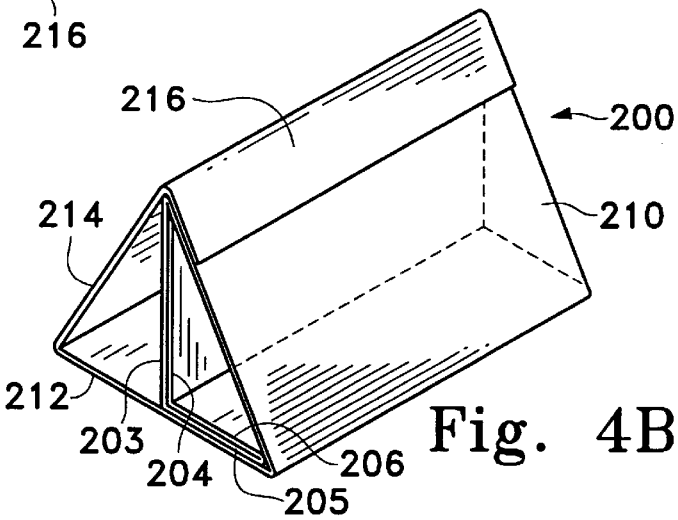
FIG. 4B is a perspective view of the folded component-shipping container assembly of FIG. 4A.
Figure 4C:
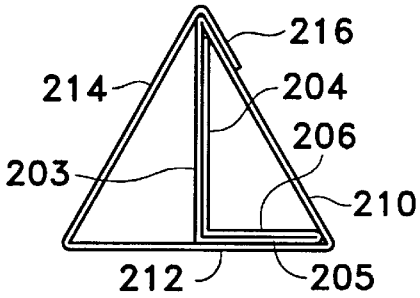
FIG. 4C shows an end view of the folded component-shipping container assembly of FIG. 4B.

A single sheet (202), as shown in FIGS. 4A, is foldable into a component-shipping container assembly (200), as shown in FIGS. 4B and 4C. The single sheet (202) provides spacer panels (205) and (206), which, when folded, reside only on one side of the first and second sections (203) and (204). Exterior panels (210), (212) and (214) are similar to their analogous brethren shown in FIG. 3A. An assembly panel (216) similar to the assembly panel (112) in FIG. 3A may also provided.

The assembly (202) may be folded by placing the article (not shown) on the first section (203) and folding at the seam (207) so that the second section (204) overlaps the first section (203) to thereby enclose the article therein. The assembly (202) is additionally somewhat simpler than the assembly (102) of FIGS. 3A–3D because each of the subsequent folds variously at (208*a*–208*b*), (220), (222), (224), and (226) is in the same direction. That is to say that once the article is enclosed within the first and second sections (203) and (204), the remainder of the sheet (202) is simply "rolled" into a form shown in FIGS. 4B and 4C with the first and second sections (203) and (204) generally bisecting the angle formed by exterior walls (210) and (214). In this variation of the invention, it is sometimes advisable to place an adhesive on the surface of spacer panel (205) where it adjoins the interior surface of exterior wall (212) to prevent shifting of the first and second sections (203) and (204) towards the interior of exterior wall (214), although such adhesive or other attachment mechanisms may not be necessary. In this variation, it may be a benefit to the overall assembly.

Figure 5A:
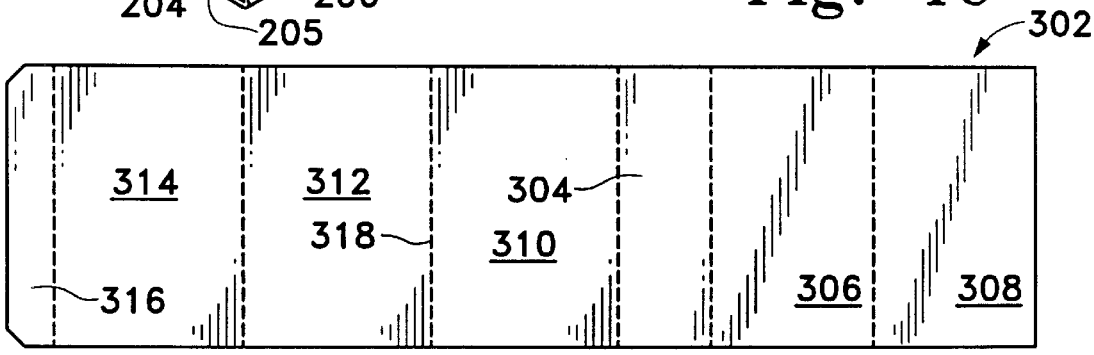
FIG. 5A is a plan view of another alternative embodiment of an unfolded shock-absorbing component of the present invention integral with and foldable into a triangular component-shipping container assembly.
Figure 5B:
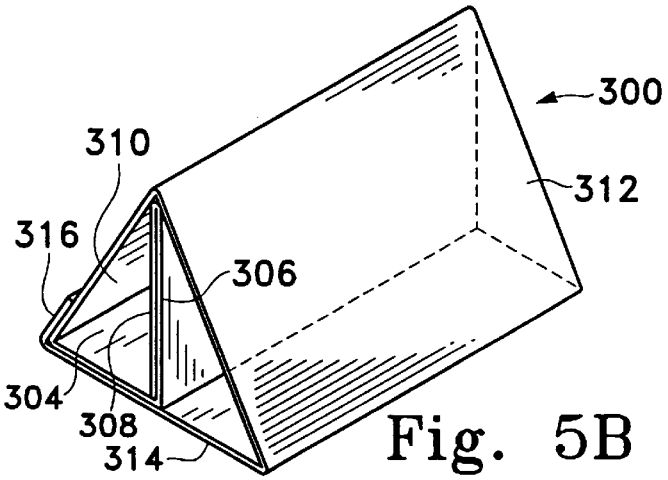
FIG. 5B is a perspective view of the folded component-shipping container assembly of FIG. 5A.
Figure 5C:
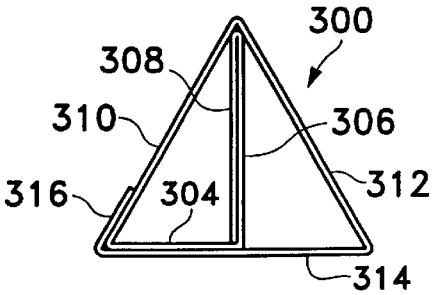
FIG. 5C shows an end view of the folded component-shipping container assembly of FIG. 5B.

FIGS. 5A–5C show still another variation (300) in which only a single spacer panel (304) is needed. In this variation, the first and second sections (306) and (308) are located at the end of the foldable sheet (302). Three exterior panels (310), (312), and (314), are used in the same way as the exterior panels were described in relation to the figures above. This variation is highly desirable because as folded and shown in FIGS. 5B and 5C, the first and second sections (306) and (308) of the component has no tendency to shift after assembly. Consequently, no additional adhesives or fasteners are needed to maintain the integrity of the finally assembled protective packaging variation (300). The depicted assembly flap (316) must be fastened in some manner to the exterior container wall (310) so to provide rigidity to the assembly (300).

Alternatively, the assembly flap (316) may be eliminated and exterior wall (314) may be provided with an adhesive strip (not shown) and placed in such a way that it will adhere to spacer panel (304). Thus, in this variation, there is no tendency after assembly for any of the component sheets to creep from its assembled position. It should be apparent to one of ordinary skill in the art that other fasteners such as staples or the like may be used in place of the adhesive strip to cause the exterior container wall (314) to adhere to spacer panel (304). The free ends of the first and second sections (306) and (308) of the component are held in place in a folded seam (318) between exterior container walls (310) and (312).

Preferably, the overall component-shipping container assembly has a triangular cross-sectional shape. However, a square or rectangular cross-sectional shape may also be suitable. FIGS. 6A–6C and 7A–7D show additional variations of the invention in which the overall cross-section of the component-shipping container assembly is square or rectangular rather than triangular as has been the case with the figures discussed above.

Figure 6A:
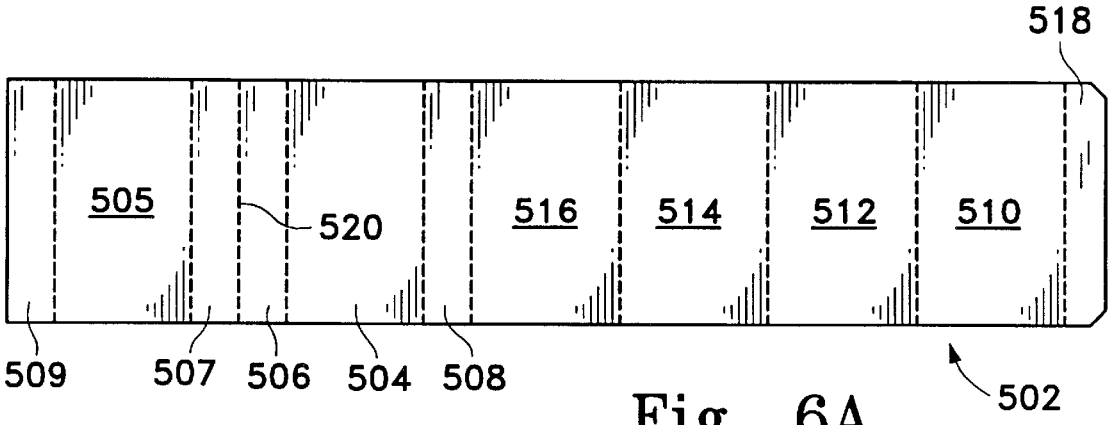
FIG. 6A shows a plan view of an alternative embodiment of an unfolded shock-absorbing component of the present invention integral with and foldable into a rectangular component-shipping container assembly.
Figure 6B:
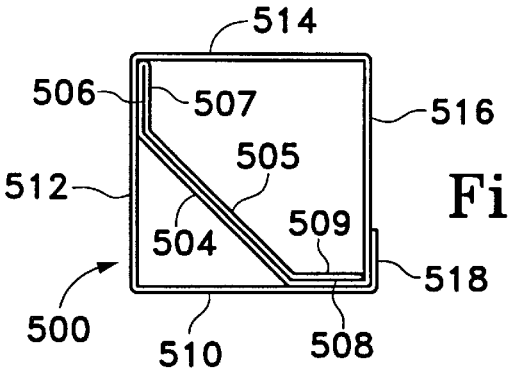
FIG. 6B shows an end view of the folded component-shipping container assembly of FIG. 6A.
Figure 6C:
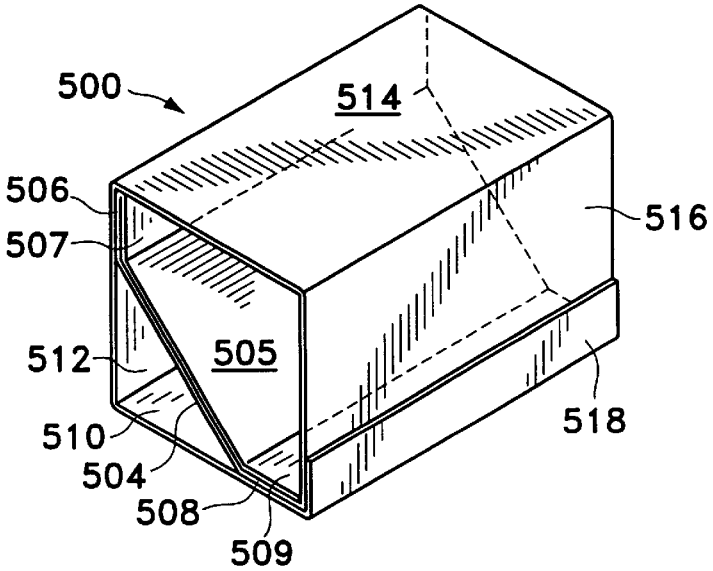
FIG. 6C shows a front quarter view of the component-shipping container assembly of FIGS. 6A and 6B.

FIG. 6A shows a plan view of a variation shown as folded assembly (500) in FIGS. 6B and 6C. This variation of the invention includes a first section (505), a second section (504), and spacer panels (506), (507), (508) and optional spacer panel (509). They are spaced in such a way that in the folded configurations as shown in FIGS. 6B and 6C, spacer panels (506) and (507) overlap each other and, similarly, spacer panels (508) and (509) overlap each other. Spacer panels (508) and (506) adjoins the interior surfaces of exterior container walls (510) and (512), respectively. The first and second sections (505) and (504) are situated so that it provides a maximum of interior volume between the face of the first section (505) and the interior surfaces of exterior container walls (514) and (516). In this variation (500), the container may be constructed without need for ends to enclose the volume within the box. For instance, this may be done by being sure that spacer panels (506), (508) and (509) and assembly panel (518) adhere, respectively, to the interior surface of exterior container wall (512), the interior surface of exterior container wall (510), the overlapping surface of spacer panel (508), and the exterior surface of exterior container wall (516).

Thus, a triangular portion of the box is formed between second section (504) and exterior walls (512) and (510). This triangular cross-section box portion is a determinate structure and will provide a great deal of rigidity to the overall assembly (500). It may be desirable in certain circumstances, however, to provide some sort of a capping or insert device at the ends of the first and second sections (505) and (504) to close the assembly (500).

The article to be packaged may be placed upon second section (504) and first section (505) may then be folded onto the second section (504) along seam (520) to enclose the article therein. The component-shipping container assembly (500) may then be folded beginning with the spacer panels (506) and (507) and simply "rolled" into a shape which has a substantial amount of rigidity once the proper adhesion points are provided.

Figure 7A:
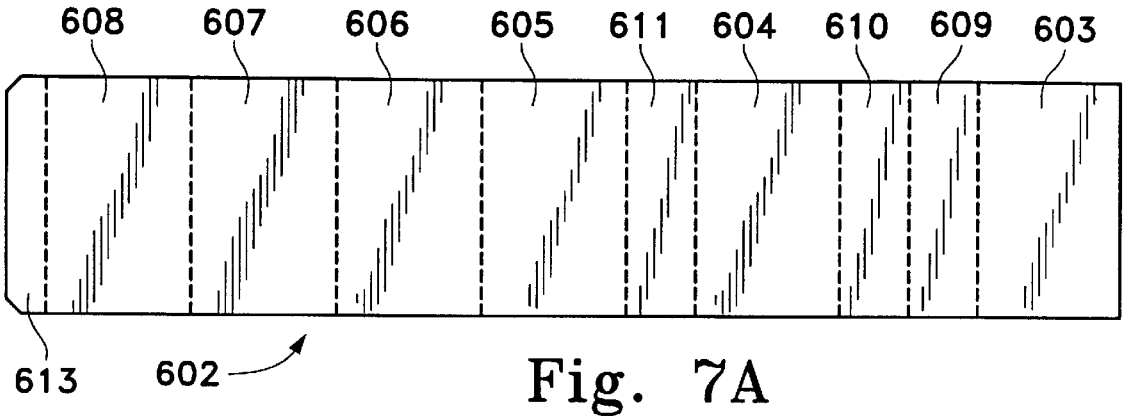
FIG. 7A shows a plan view of another embodiment of an unfolded shock-absorbing component of the present invention integral with and foldable into a rectangular component-shipping container assembly.
Figure 7C:
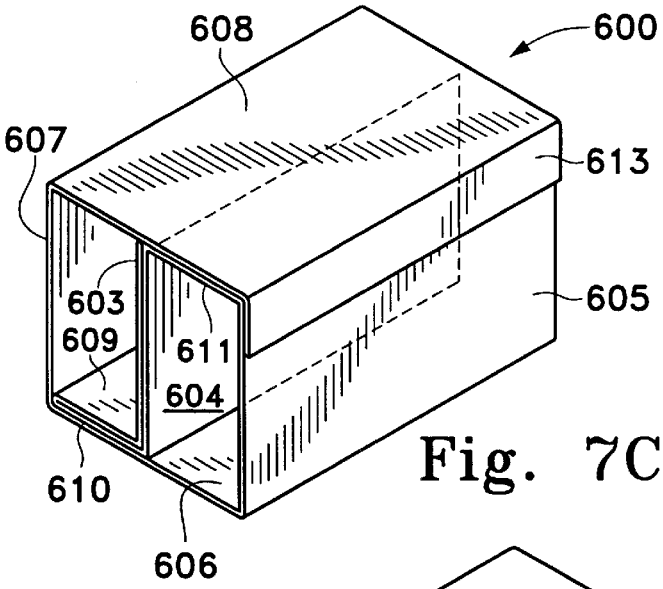
FIG. 7C shows a front quarter view of the component-shipping container assembly of FIGS. 7A and 7B.
Figure 7B:
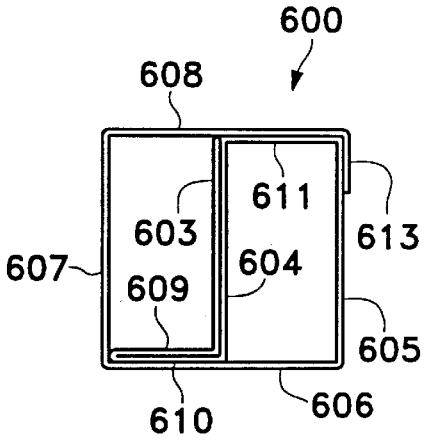
FIG. 7B shows an end view of the folded component-shipping container assembly of FIG. 7A.
Figure 7D:
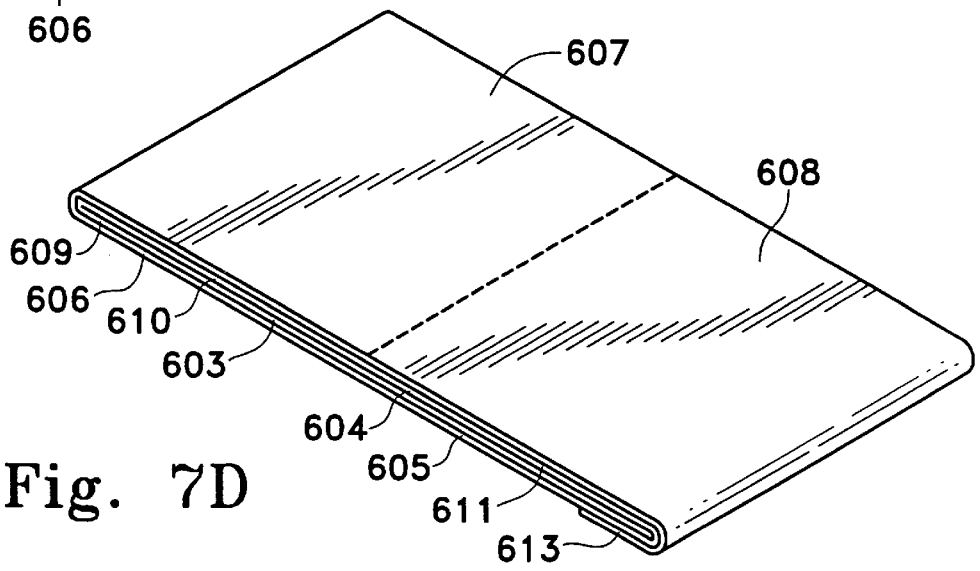
FIG. 7D shows a front quarter view of the folded component-shipping container assembly of FIG. 7A after it has been collapsed.

FIG. 7A is yet another variation of the inventive device (600), as shown folded in FIGS. 7B and 7C. It too uses a sheet of flat stock (602) creased in the appropriate places. As may be noted in FIGS. 7B and 7C, the first and second sections (603) and (604) extend between the interior surfaces of exterior walls (606) and (608). This assembly (600) has the benefit that since it is not determinate, it may be simply folded over and preassembled using assembly flap (613) into the shape shown in FIG. 7D. Again, this structure is not determinate in nature and consequently could use a pair of ends of some type to provide it with some rigidity. Nevertheless, the first and second sections (603) and (604) provide a region in its center which is spaced apart from each of the exterior walls when assembled as shown in FIGS. 7B and 7C.

End Assemblies

As noted above, the manner in which the ends of this shipping protection assembly is closed is not particularly critical to the concept of this invention. However, FIGS. 8A–B, 9A–B, 10A–B, 11A–B and 12A–D show various suitable capping assemblies for the component-shipping container assembly of the present invention. For purposes of simplicity and clarity, FIGS. 8A–B, 9A–B, 10A–B, 11A–B and 12A–D do not show the component or the spacer panels in the component-shipping container assembly. However, it is to be understood by one of ordinary skill in the art that these capping assemblies are utilized with the component-shipping container assembly of the present invention.

FIGS. 8A and 8B show a simple outer cap (700) having an end component (702) and three side walls (704). The cap (700) is sized in such a fashion that it fits on the outside of the foldable component-shipping container assembly shown, e.g., in FIGS. 3A through 5C. Although not shown, the cap may be adapted to fit outside of a rectangular component-shipping container assembly shown, e.g. in FIGS. 6A–7C. The outer cap (700) may be stapled or glued or otherwise made to adhere to the remainder of the component-shipping container assembly.

FIGS. 9A and 9B show similarly constructed end cap (800) also having an end piece (802) and side walls (804). However, instead of fitting on the exterior of one of the prismatic shaped variations of the inventive component-shipping container assembly shown in FIGS. 3A–5C, end assembly (800) fits into the interior space of the inventive assembly. End assembly (800) may be glued or stapled in place. Other discrete devices may be used to be independently placed on the exterior or interior of the prismatic or rectangular assemblies discussed above.

Figure 10A:
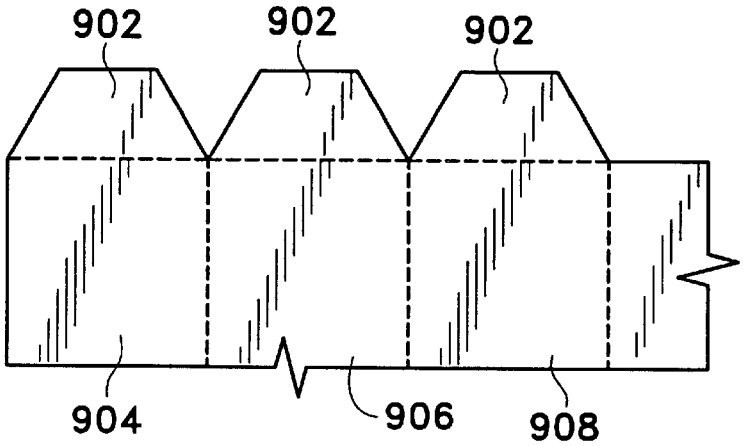
FIG. 10A shows a partial plan view of the unfolded sheet of end flaps for the inventive component-shipping container assembly.
Figure 10B:
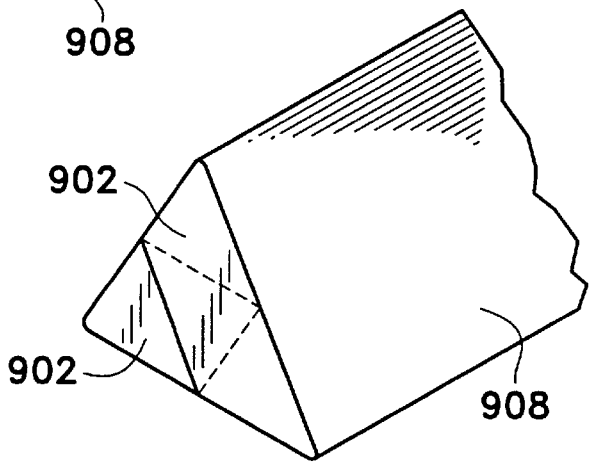
FIG. 10B shows a front quarter view of the folded end flaps as shown in FIG. 10A.

FIGS. 10A and 10B show an integral set of end panels which are placed on the side of exterior container walls (904), (906) and (908). When folded into the prismatic configuration shown in FIG. 9B, end leaves (904) may be interleaved to form a closed end.

Figure 11A:
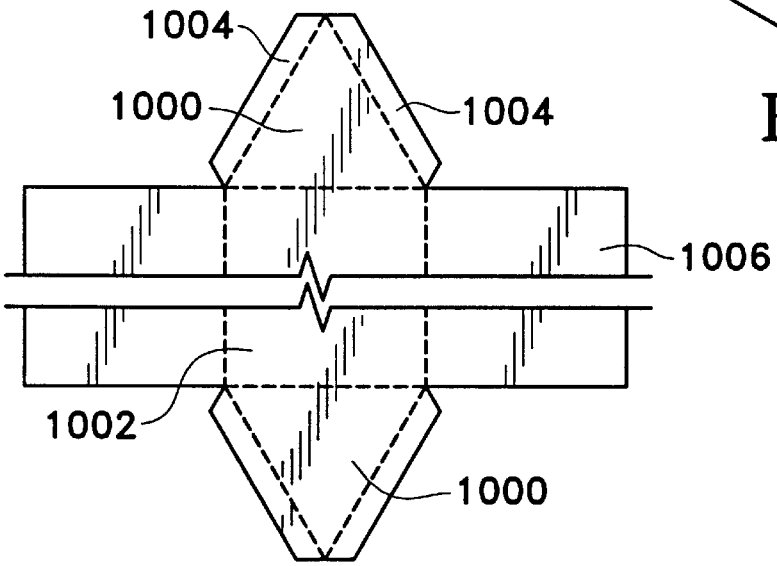
FIG. 11A shows a partial plan view of the unfolded sheet of end flaps for the inventive component-shipping container assembly.
Figure 11B:
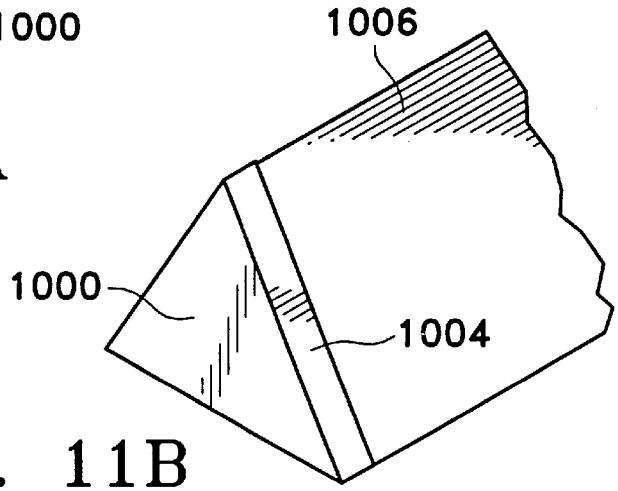
FIG. 11B shows a front quarter view of the folded end flaps as shown in FIG. 11A.

Another simple end-closing assembly may be seen in FIG. 11A. In this variation, a pair of triangular field flaps (1000) are attached via a folding seam to an exterior container wall (1002). Assembly or glue flaps (1004) are provided on triangular end cap (1000). When folded as shown in FIG. 11B, the assembly flaps (1004) simply overlap onto the adjacent exterior container walls (1006) where they may be glued or stapled to secure the end flap (1002) in place.

A final, somewhat more elegant solution to providing a readily used end assembly is found in FIGS. 12A–12D. In this variation, only a single end assembly is shown for clarity of explanation.

Figure 12A:
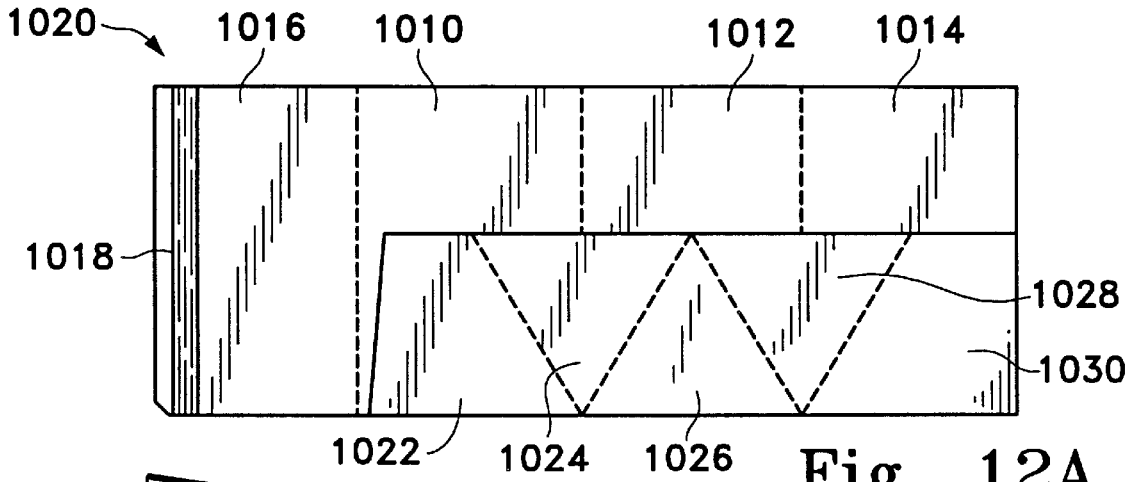
FIG. 12A shows a partial plan view of the unfolded sheet of an end construction for the inventive component-shipping container assembly.

The partial protective packaging assembly shown incorporates three exterior container walls (1010), (1012), and (1014). Assembly flap (1016) with an adhesive strip (1018) is also shown for illustration. In the lower part of FIG. 12A is shown end flap assembly (1020) which is made up of five panels (1022), (1024), (1026), (1028), and (1030). The flap assembly (1020) may be made by simply folding up a lower edge of the three exterior container walls (1010), (1012), and (1014) to provide the noted flap assembly (1020). A "W"-shaped crease is provided in flap assembly (1020). This permits region (1022) and (1030) to be glued to their respective exterior container walls (1010), (1014). Panels (1024), (1026), and (1028) are free to move as the assembly is folded.

Figure 12B:
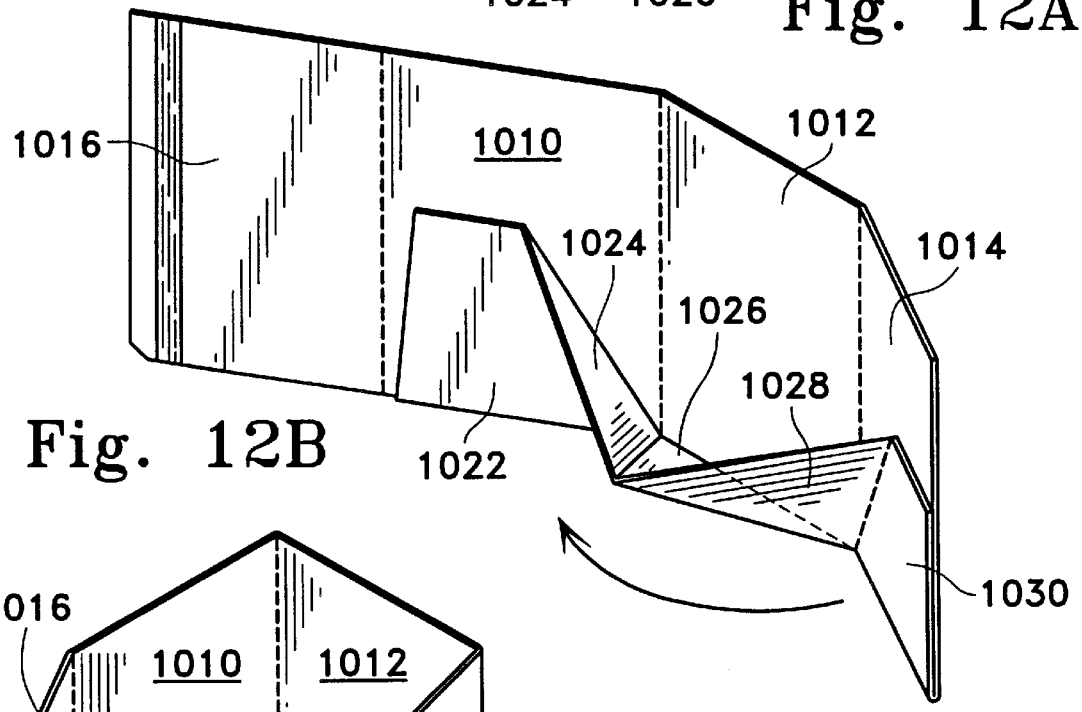
FIGS. 12B and 12C show the steps of folding the FIG. 12A assembly.
Figure 12C:
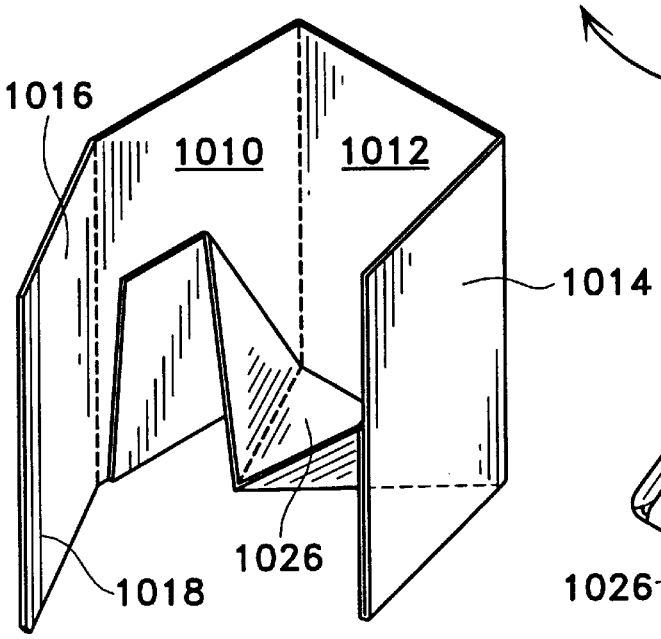
Figure 12D:
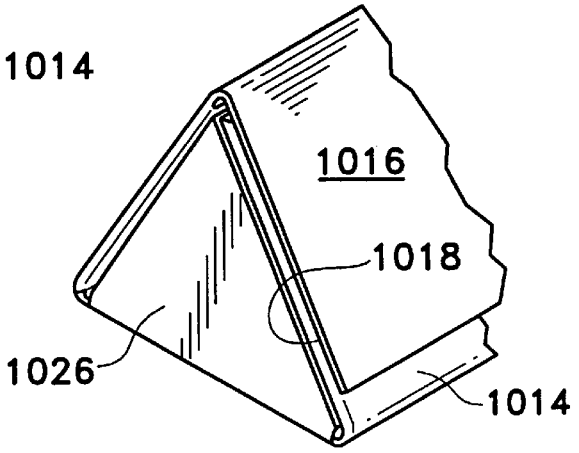
FIG. 12D shows a reverse view of the folded end construction for the inventive component-shipping container assembly made according to FIG. 12A.

FIG. 12B shows the beginning of the steps needed to fold the device into a configuration having a single end cap (1026). As the sheet is folded, panels (1022) and (1030) remain in place. FIG. 12C shows a further step in that folding. Finally, FIG. 12D shows (from a reverse view of the FIG. 12C perspective) the finally folded end assembly with panel (1026) in place and construction flap (1018) overlying exterior container wall (1014) to cover the end of the assembly.

Other variations, both integral with the disclosed assembly or added independently to the end of the assembly, should also be apparent from these teachings.

This invention has been described and specific examples of the invention have been portrayed. Use of those specifics is not intended to limit the invention in any way. Additionally, to the extent there are variations of the invention which are within the spirit of the disclosure and yet are equivalent to the invention found in the claims, it is our intent that this patent cover those variations as well.

I claim as my invention:

1. A component for packaging an article, the article having a first portion with a first shape and a second portion with a second shape, the component comprising:

a first section capable of receiving the article and being in contact with the first portion of the article;

a plurality of non-straight cuts through said first section, wherein a first area of said first section containing said cuts is capable of deforming and at least partially conforming to the first shape of the first portion of the article and a second area of said first section outside of said cuts is generally non-deformable and nonconforming; and a second section capable of receiving the article and being in contact with the second portion of the article, wherein when the article is placed between said first section and second section, the article is substantially enclosed by said first and second sections.

2. The component for packaging of claim 1, further comprising a foldable seam disposed between said first section and said second section, said first section foldable toward said second section along said foldable seam.

3. The component for packaging of claim 1, wherein at least some of said cuts are evenly spaced therebetween.

4. The component for packaging of claim 1, wherein at least some of said cuts are unevenly spaced therebetween.

5. The component for packaging of claim 1, wherein at least some of said cuts are of a zig zag configuration or shape.

6. The component for packaging of claim 1, wherein at least some of said cuts are of a tortuous shape.

7. The component for packaging of claim 1, further comprising a plurality of non-straight cuts through said second section, wherein a first area of said second section containing said cuts is capable of deforming and at least partially conforming to the second shape of the second portion of the article and a second area of said second section outside of said cuts is generally non-deformable and nonconforming.

8. The component for packaging of claim 1, wherein said cuts have non-uniform lengths.

9. The component for packaging of claim 1, further comprising at least one flexible sheet affixed to a surface of at least one of said sections, said sheet is at least partially disposed over said cuts.

10. The component for packaging of claim 9, wherein said cuts extend through said plastic sheet.

11. A protective container for packaging an article, the article having a first portion with a first shape and a second portion with a second shape, the container comprising:

a foldable sheet which upon folding forms a protective container comprising:

i.) a plurality of container walls which upon said folding, form said protective container having an outer surface and an inner volume;

ii.) a component comprising a first section capable of receiving the article and being in contact with the first portion of the article, said first section having a plurality of non-straight cuts therethrough, wherein a first area of said first section containing said cuts is capable of deforming and at least partially conforming to the first shape of the article and a second area of said first section outside of said cuts being generally non-deformable, said component further comprising a second section capable of receiving the article and being in contact with the second portion of the article, wherein when the article is placed between said first section and second section, the article is substantially enclosed by said first and second sections; and iii.) at least one spacer panel foldably attached to at least one edge of at least one of said sections, wherein upon said folding said spacer panel positions two opposing edges of said component against said containing walls and spaces said first and second sections away from said containing walls.

12. The protective container of claim 11 wherein at least one of said sections has at least one edge foldably attached to a container wall.

13. The protective container of claim 11, wherein one edge of said first section is foldably attached to an edge of said second section.

14. The protective container of claim 11, wherein at least some of said cuts are evenly spaced therebetween.

15. The protective container of claim 11, wherein at least some of said cuts are unevenly spaced therebetween.

16. The protective container of claim 11, wherein said cuts have non-uniform lengths.

17. The protective container of claim 11, wherein at least some of said cuts are of a zig-zag shape.

18. The protective container of claim 11, wherein at least some of said cuts are of a tortuous shape.

19. The protective container of claim 11, said second section having a plurality of non-straight cuts therethrough, wherein an area of said second section containing said cuts is capable of deforming and at least partially conforming to the second shape of the second portion of the article and a second area of said second section outside of said cuts is generally non-deformable and nonconforming.

20. The protective container of claim 11 comprising exactly three container walls.

21. The protective container of claim 11 comprising exactly four container walls.

22. The protective container of claim 11, further comprising at least one flexible sheet affixed to a surface of at least one of said sections, said sheet is at least partially disposed over said cuts.

23. The protective container of claim 22, wherein said cuts extend through said plastic sheet.

* * * * *